US012667138B2

(12) United States Patent
Mironov et al.

(10) Patent No.: US 12,667,138 B2
(45) Date of Patent: Jun. 30, 2026

(54) AEROSOL-GENERATING DEVICE AND METHOD WITH PUFF DETECTION

(71) Applicant: Philip Morris Products S.A., Neuchâtel (CH)

(72) Inventors: Oleg Mironov, Cudrefin (CH); Enrico Stura, Palézieux-Village (CH); Maxime Ducros, Les Hôpitaux-Neufs (FR); Daniela Hau, Cudrefin (CH)

(73) Assignee: Philip Morris Products S.A., Neuchâtel (CH)

( * ) Notice: Subject to any disclaimer, the term of this patent is extended or adjusted under 35 U.S.C. 154(b) by 609 days.

(21) Appl. No.: 18/003,471

(22) PCT Filed: Jun. 30, 2021

(86) PCT No.: PCT/EP2021/068099
§ 371 (c)(1),
(2) Date: Dec. 27, 2022

(87) PCT Pub. No.: WO2022/003072
PCT Pub. Date: Jan. 6, 2022

(65) Prior Publication Data

US 2023/0240378 A1 Aug. 3, 2023

(30) Foreign Application Priority Data

Jun. 30, 2020 (EP) ..... 20183280

(51) Int. Cl.
*A24F 40/53* (2020.01)
*A24F 40/20* (2020.01)

(52) U.S. Cl.
CPC ..... *A24F 40/53* (2020.01); *A24F 40/20* (2020.01)

(58) Field of Classification Search
CPC ..... A24F 40/00; A24F 40/10; A24F 40/20; A24F 40/53; H05B 2203/021
(Continued)

(56) References Cited

U.S. PATENT DOCUMENTS 10,512,282 B2 12/2019 Bowen et al.
2015/0230521 A1* 8/2015 Talon ..... A24F 40/50 131/328
(Continued)

FOREIGN PATENT DOCUMENTS

CN 110279153 A 9/2019
EP 3488714 A1 5/2019
(Continued)

OTHER PUBLICATIONS

Japanese Office Action issued May 29, 2025, in corresponding Japanese Patent Application No. 2022-579997 (with English Translation), 6 pages.
(Continued)

*Primary Examiner* — Sang Y Paik
(74) *Attorney, Agent, or Firm* — Oblon, McClelland, Maier & Neustadt, L.L.P.

(57) ABSTRACT

A method of operating an aerosol-generating device is provided, the device including a power supply to supply power to generate the aerosol, and a controller, the method including: monitoring a parameter indicative of aerosol generation during operation of the device; and analysing the monitored parameter to identify a user puff defined by a puff start and end, the analysing including calculating first and second characteristics of the monitored parameter, and analysing the first and the second characteristics to determine the puff start and end, the parameter indicative of aerosol generation representing power supplied by the power supply, the first and the second characteristics respec-
(Continued)

tively being a first and a second moving average value of the monitored parameter computed on a first and a second time window having a first and a second time window duration, the second time window duration being different from the first time window duration.

19 Claims, 8 Drawing Sheets

(58) Field of Classification Search
USPC ..... 392/386
See application file for complete search history.

(56) References Cited

U.S. PATENT DOCUMENTS

| | | | | |
|---|---|---|---|---|
| 2016/0157524 | A1 | 6/2016 | Bowen et al. | |
| 2017/0055585 | A1* | 3/2017 | Fursa | A24F 40/46 |
| 2018/0042306 | A1* | 2/2018 | Atkins | A24F 40/46 |
| 2019/0133198 | A1 | 5/2019 | Nakano et al. | |
| 2019/0142067 | A1 | 5/2019 | Martzel | |
| 2019/0217028 | A1 | 7/2019 | Nakano | |
| 2019/0246698 | A1 | 8/2019 | Nakano et al. | |
| 2019/0246703 | A1 | 8/2019 | Nakano et al. | |
| 2020/0000146 | A1* | 1/2020 | Anderson | H02J 7/0045 |
| 2020/0008474 | A1 | 1/2020 | Soriano et al. | |
| 2020/0120987 | A1 | 4/2020 | Atkins et al. | |
| 2020/0187559 | A1 | 6/2020 | Nakano et al. | |
| 2020/0237017 | A1* | 7/2020 | Tu | A24F 13/00 |

FOREIGN PATENT DOCUMENTS

| | | | |
|---|---|---|---|
| EP | 3513667 | A1 | 7/2019 |
| EP | 3563698 | A1 | 11/2019 |
| RU | 2 647 805 | C2 | 3/2018 |
| RU | 2 690 102 | C2 | 5/2019 |
| RU | 2 725 092 | C2 | 6/2020 |
| WO | WO 2017/141358 | A1 | 8/2017 |
| WO | WO 2020/006305 | A1 | 1/2020 |

OTHER PUBLICATIONS

Partial European Search Report issued on Dec. 8, 2020 in European Patent Application No. 20183280.5, 12 pages.
Extended European Search Report issued on Mar. 5, 2021 in European Patent Application No. 20183280.5, 14 pages.
International Search Report Issued Oct. 4, 2021, in PCT/EP2021/068099, filed on Jun. 30, 2021, 5 pages.
Written Opinion Issued Oct. 4, 2021, in PCT/EP2021/068099, filed on Jun. 30, 2021, 6 pages.
Combined Russian Office Action and Search Report issued on Dec. 17, 2024 in Russian Patent Application No. 2023101744, 11 pages.

* cited by examiner

MAC (Moving Average Crossover) method was chosen to detect critical events characterizing each puff.

Blue trace: Short moving average (128ms)
Orange trace: Long moving average (512ms)

1st trigger: Short > Long + 0.22 W
2nd trigger: Long > Short
3rd trigger: Long > Short + 0.18 W
4th trigger: Short > Long – 0.06W AND Long < $Long_{1st}$ + 0.31W

AEROSOL-GENERATING DEVICE AND METHOD WITH PUFF DETECTION

The present disclosure relates to a method for detecting user puffs on an aerosol-generating device, a device configured to detect user puffs, and a method of controlling operation of an aerosol-generating device based on user puffs. In particular, the disclosure relates to an improved method of detecting puffs and to a method of controlling operation of an aerosol-generating device based on a calculated volume of aerosol-delivered.

Aerosol-generating devices configured to generate an aerosol from an aerosol-forming substrate, such as a tobacco containing substrate, are known in the art. Typically, an inhalable aerosol is generated by the transfer of heat from a heat source to a physically separate aerosol-forming substrate or material, which may be located within, around or downstream of the heat source. An aerosol-forming substrate may be a liquid substrate contained in a reservoir. An aerosol-forming substrate may be a solid substrate. An aerosol-forming substrate may be a component part of a separate aerosol-generating article configured to engage with an aerosol-generating device to form an aerosol. During consumption, volatile compounds are released from the aerosol-forming substrate by heat transfer from the heat source and entrained in air drawn through the aerosol-generating article. As the released compounds cool, they condense to form an aerosol that is inhaled by the consumer.

Some aerosol-generating devices are configured to provide user experiences that have a finite duration. The duration of a usage session may be limited, for example, to approximate the experience of consuming a traditional cigarette. Some aerosol-generating devices are configured to be used with separate, consumable, aerosol-generating articles. Such aerosol-generating articles comprise an aerosol-forming substrate or substrates that are capable of releasing volatile compounds that can form an aerosol. Aerosol-forming substrates are commonly heated to form an aerosol. As the volatile compounds in an aerosol-forming substrate are depleted, the quality of the aerosol produced may deteriorate. Thus, some aerosol-generating devices are configured to limit the duration of the usage session to help prevent generation of a lower quality aerosol from a substantially depleted aerosol-generating article.

In some aerosol-generating devices, the duration of a usage session may be determined purely by time. One problem associated with setting a limit on a usage session purely based on time is that no account is taken of use behaviour of a user. Thus, a user that takes a large number of puffs may deplete available aerosol-forming substrate within the duration of a usage session. In some aerosol-generating devices, the number of puffs taken by a user during a usage session is recorded and the duration of a usage session may be determined partially or completely based on the number of puffs taken by a user. As an example, an aerosol-generating device may be configured to consume an aerosol-generating article during a usage session and the usage session may be terminated after a user has taken 12 puffs on the aerosol-generating article. Users taking 12 long puffs may still deplete available aerosol-forming substrate within their usage session, while users taking 12 short puffs may find their usage session is terminated before the available aerosol-forming substrate has been fully consumed.

According to an aspect of the present invention, there is provided a method of operating an aerosol-generating device for generating an aerosol from an aerosol-forming substrate. The aerosol-generating device comprises a power supply for supplying power to generate the aerosol, and a controller. The method comprises steps of monitoring a parameter indicative of aerosol generation during operation of the aerosol-generating device, analysing the monitored parameter to identify a user puff, the user puff defined by a puff start and a puff end. The invention may comprise steps of analysing the monitored parameter during the user puff to calculate a puff volume, the puff volume being a volume of aerosol generated during the user puff, and using the puff volume as a parameter for controlling operation of the device.

By controlling operation of the aerosol-generating device on the basis of puff volume, it may be possible to fully utilise aerosol-forming substrate in an aerosol forming article. A user who takes longer or deeper puffs may have their usage session terminated after taking fewer puffs than a user who takes shorter or shallower puffs. Thus, the duration of a usage session may be controlled such that the total amount of aerosol inhaled is approximately the same irrespective of the puffing style of the user.

By controlling operation of the aerosol-generating device on the basis of puff volume, it may be possible to maintain the quality of aerosol produced within a predetermined range. This may be important for sensual reasons, such as perception, for example maintaining a consistent taste during the usage session. Maintaining quality may also be important for compliance and regulatory reasons. For example, if an aerosol-generating device is certified or validated to produce a specific volume of aerosol within a usage session, then a user who takes strong puffs or long puffs may conduct a usage session that results in an aerosol being delivered that is outside the specification. Thus, the usage session may be controlled such that the quality of aerosol produced during the usage session remains within acceptable or certified boundaries irrespective of the puffing style of the user.

The parameter indicative of aerosol generation may be representative of power supplied by the power supply. Current, voltage, or both current and voltage, supplied to a heater may be parameters representative of power. For example, a power supply may supply power to maintain a heater at a predetermined temperature during a usage session. If a user puffs on the device to generate an aerosol, the heater cools and a greater amount of power is required to maintain the heater at the predetermined temperature. Thus, by monitoring a parameter representative of power supplied by the power supply, a value indicative of real time aerosol generation may be recorded.

The aerosol-generating device may be configured to generate the aerosol during a usage session. The method may comprise steps of, determining a start of the usage session, monitoring the parameter indicative of aerosol generation during the usage session, and using the puff volume as a parameter for determining the end of the usage session.

The monitored parameter may be analysed to identify a plurality of user puffs performed during operation of the device, each of the plurality of user puffs having a puff start and a puff end determined by analysing the monitored parameter. The monitored parameter may be analysed during each of the plurality of identified user puffs to calculate a puff volume for each of the plurality of user puffs. A cumulative puff volume of aerosol generated during each of the plurality of identified user puffs may be determined. The cumulative puff volume may be used as a parameter for controlling operation of the device. By determining a puff volume for each puff taken, a cumulative puff volume may be determined. In this manner the device may be controlled more accurately even if a user takes inconsistent puffs, that is combinations of puffs having low puff volume and puffs having high puff volume.

The method may comprise steps of, determining a start of the usage session, monitoring the parameter indicative of aerosol generation during the usage session, and using the cumulative puff volume as a parameter for determining the end of the usage session.

The controller may end the usage session if a time elapsed from the start of the usage session reaches a predetermined threshold. It may be desirable that a usage session has an upper limit based on time in the event that a user stops using the device before generating a maximum allowed amount of aerosol. Thus, a usage session may be safely ended in the event of inaction on the user's part.

The controller may end a usage session if the puff volume, or the cumulative puff volume, generated from the start of the usage session reaches a predetermined threshold. Thus, a usage session may be ended after a predetermined volume of aerosol has been generated and before the aerosol-forming substrate has been depleted sufficiently for aerosol quality to diminish.

A function of the monitored parameter may be calculated in real time and evaluated to determine puff volume. Calculating puff volume in real time allows a more accurate control over the usage session and the quality of aerosol delivered in the usage session.

The step of analysis of the monitored parameter may comprise steps of calculating a first characteristic of the monitored parameter and analysing the first characteristic to determine a puff start and a puff stop. The step of analysis of the monitored parameter may comprise steps of calculating a second characteristic of the monitored parameter and analysing both the first characteristic and the second characteristic to determine the puff start and the puff stop. The more accurately a puff start and a puff stop can be determined, the more accurate a calculation of puff volume can be.

A puff start may be determined to have occurred when the first characteristic and the second characteristic satisfy one or more predetermined conditions. A puff end may be determined to have occurred when the first characteristic and the second characteristic satisfy one or more predetermined conditions.

The first characteristic may be a first moving average value, first moving median value, or any other suitable signal characteristic value, of the monitored parameter computed on a first time window having a first time window duration. The second characteristic may be a second moving average value, second moving median value, or any other suitable signal characteristic value, of the monitored parameter computed on a second time window having a second time window duration, the second time window duration being different to the first time window duration.

A puff start may be determined when the first characteristic, for example the first moving average value, and the second characteristic, for example the second moving average value, meet a predetermined relationship with respect to each other. For example, the first time window duration may be shorter than the second time window duration and a puff start may be determined when the first moving average increases with respect to the second moving average and reaches a puff start value in which the first moving average equals the second moving average plus a first predetermined puff start constant.

A puff end may be determined when the first characteristic, for example the first moving average value, and the second characteristic, for example the second moving average value, meet a predetermined relationship with respect to each other. For example, a puff end may be determined when the first moving average decreases with respect to the second moving average, after the detection of a puff start, and reaches a puff end value in which the first moving average is greater than the second moving average minus a first predetermined puff end constant, and the second moving average is lesser than the value of the second moving average at puff start plus a second predetermined puff end constant.

The, or each, puff volume may be determined by integration of a curve representing the monitored parameter as a function of time between the, or each, puff start and the, or each, puff end.

According to an aspect of the present invention, there is provided an aerosol-generating device for generating an aerosol from an aerosol-forming substrate. The aerosol-generating device may comprise a power supply for supplying power to generate the aerosol, and a controller configured to monitor a parameter indicative of aerosol generation during operation of the aerosol-generating device, analyse the monitored parameter to identify a user puff, the user puff defined by a puff start and a puff end, analyse the monitored parameter during the user puff to calculate a puff volume, the puff volume being a volume of aerosol generated during the user puff, and control operation of the device based on calculated the puff volume. The aerosol-generating device may be configured to perform any method described above.

The device may comprise a heater and the monitored parameter may be, or may be representative of, power supplied to the heater during operation of the aerosol-generating device.

The heater may be an induction heater and the monitored parameter may be representative of energy absorbed by a susceptor. Such a susceptor may be a component part of the aerosol-generating device or may be a component of an aerosol-forming article for use with an aerosol-generating device.

The heater may be a resistance heater and the monitored parameter may be representative of energy supplied to the resistance heater.

The aerosol-generating device is preferably configured to receive an aerosol-generating article comprising the aerosol-forming substrate.

According to an aspect of the present invention, there is provided a method of operating an aerosol-generating device for generating an aerosol from an aerosol-forming substrate, the aerosol-generating device comprising a power supply for supplying power to generate the aerosol, and a controller. The method may comprise steps of monitoring a parameter indicative of aerosol generation during operation of the aerosol-generating device, and analysing the monitored parameter to identify a user puff, the user puff defined by a puff start and a puff end. The step of analysing the monitored parameter may comprise steps of calculating a first characteristic of the monitored parameter, calculating a second characteristic of the monitored parameter, and analysing both the first characteristic and the second characteristic to determine the puff start and the puff stop.

The monitored parameter may be analysed to identify a plurality of user puffs performed during operation of the device, each of the plurality of user puffs having a puff start and a puff end determined by analysing the monitored parameter.

The aerosol-generating device may be configured to generate the aerosol during a usage session. The method may then comprise steps of determining a start of the usage session, and analysing the monitored parameter to identify the user puff, or the plurality of user puffs, performed during operation of the device.

A puff start may be determined when the first characteristic and the second characteristic satisfy one or more predetermined conditions. A puff end may be determined when the first characteristic and the second characteristic satisfy one or more predetermined conditions.

The first characteristic may be a first moving average value of the monitored parameter computed on a first time window having a first time window duration. The first time window duration is preferably a time of between 20 ms and 1000 ms, for example between 100 ms and 500 ms, or between 200 ms and 500 ms. The first window time duration may be about 250 ms, or about 300 ms, or about 350 ms, or about 400 ms, or about 450 ms.

The second characteristic may be a second moving average value of the monitored parameter computed on a second time window having a second time window duration, the second time window duration being different to the first time window duration. The second time window duration is preferably a time of between 100 ms and 2000 ms, for example between 500 ms and 1500 ms, or between 800 ms and 1400 ms. The first window time duration may be about 850 ms, or about 900 ms, or about 950 ms, or about 1000 ms, or about 1050 ms, or about 1100 ms, or about 1200 ms.

A puff start may be determined when the first moving average value and the second moving average value meet a predetermined relationship with respect to each other.

The first time window duration may be shorter that the second time window duration and a puff start may be determined when the first moving average increases with respect to the second moving average and reaches a puff start value in which the first moving average equals the second moving average plus a first predetermined puff start constant. The puff start constant may be, preferably, an empirically determined constant. The puff start constant may, alternatively, be a calculated constant.

A puff end may be determined when the first moving average decreases with respect to the second moving average, after the detection of a puff start, and reaches a puff end value in which the first moving average is greater than the second moving average minus a first predetermined puff end constant, and the second moving average is lesser than the value of the second moving average at puff start plus a second predetermined puff end constant. The first predetermined puff end constant and the second predetermined puff end constant may be, preferably, empirically determined constants. The first predetermined puff end constant and the second predetermined puff end constant may be, alternatively, calculated constants.

It may be possible that general noise in the monitored parameter means that criteria for a puff start are met when a genuine puff has not taken place. In order to minimise recording of such events as puffs, one or more predetermined validation conditions may be required to be met, after a puff start has been determined, to verify that a puff has taken place. A validation condition may be termed a trigger. Unless the validation condition, or each validation condition, is met, a puff is not recorded. As an example, once a puff start has been determined, a valid puff may only be recorded if a first validation condition is met and a puff end is detected. As a further example, once a puff start has been determined, a valid puff may only be recorded if a first validation condition is met, and a second validation is met, and a puff end is detected According to an aspect of the present invention, there is provided an aerosol-generating device for generating an aerosol from an aerosol-forming substrate, the aerosol-generating device comprising a power supply for supplying power to generate the aerosol, and a controller configured to monitor a parameter indicative of aerosol generation during operation of the aerosol-generating device, and analyse the monitored parameter to identify a user puff, the user puff defined by a puff start and a puff end. The controller may be programmed to analyse the monitored parameter by calculating a first characteristic of the monitored parameter, calculating a second characteristic of the monitored parameter, and analysing both the first characteristic and the second characteristic to determine the puff start and the puff stop. The aerosol-generating device may be configured to perform a method as described above.

The device may comprise a heater and the monitored parameter may be, or may be representative of, power supplied to the heater during operation of the aerosol-generating device. The heater may be an induction heater and the monitored parameter may be representative of energy absorbed by a susceptor. The heater may be a resistance heater and the monitored parameter may be representative of energy supplied to the resistance heater. The aerosol-generating device is preferably configured to receive an aerosol-generating article comprising the aerosol-forming substrate.

The invention is defined in the claims. However, below there is provided a non-exhaustive list of non-limiting examples. Any one or more of the features of these examples may be combined with any one or more features of another example, embodiment, or aspect described herein.

Example Ex1. A method of operating an aerosol-generating device for generating an aerosol from an aerosol-forming substrate, the aerosol-generating device comprising; a power supply for supplying power to generate the aerosol, and a controller; the method comprising, monitoring a parameter indicative of aerosol generation during operation of the aerosol-generating device, analysing the monitored parameter to identify a user puff, the user puff defined by a puff start and a puff end, analysing the monitored parameter during the user puff to calculate a puff volume, the puff volume being a volume of aerosol generated during the user puff, and using the puff volume as a parameter for controlling operation of the device.

Example Ex2. A method according to example Ex1 in which, the parameter indicative of aerosol generation is representative of power supplied by the power supply.

Example Ex3. A method according to example Ex1 or Ex2 in which, the aerosol-generating device is configured to generate the aerosol during a usage session, the method comprising steps of, determining a start of the usage session, monitoring the parameter indicative of aerosol generation during the usage session, and using the puff volume as a parameter for determining the end of the usage session.

Example Ex4. A method according to any preceding example comprising the steps of, analysing the monitored parameter to identify a plurality of user puffs performed during operation of the device, each of the plurality of user puffs having a puff start and a puff end determined by analysing the monitored parameter.

Example Ex5. A method according to example Ex4 comprising steps of, analysing the monitored parameter during each of the plurality of identified user puffs to calculate a puff volume for each of the plurality of user puffs, determining a cumulative puff volume of aerosol generated during each of the plurality of identified user puffs, and using the cumulative puff volume as a parameter for controlling operation of the device.

Example Ex6. A method according to example Ex5 in which, the aerosol-generating device is configured to generate the aerosol during a usage session, the method comprising steps of, determining a start of the usage session, monitoring the parameter indicative of aerosol generation during the usage session, and using the cumulative puff volume as a parameter for determining the end of the usage session.

Example Ex7. A method according to example Ex3 or Ex6 in which the controller ends the usage session if a time elapsed from the start of the usage session reaches a predetermined threshold.

Example Ex8. A method according to example Ex3, Ex6 or Ex7 in which the controller ends the usage session if the puff volume, or the cumulative puff volume, generated from the start of the usage session reaches a predetermined threshold.

Example Ex9. A method according to any preceding example in which a function of the monitored parameter is calculated in real time and evaluated to determine puff volume.

Example Ex10. A method according to any preceding example in which the step of analysis of the monitored parameter comprises steps of calculating a first characteristic of the monitored parameter and analysing the first characteristic to determine a puff start and a puff stop.

Example Ex11. A method according to example Ex10 in which the step of analysis of the monitored parameter comprises steps of calculating a second characteristic of the monitored parameter and analysing both the first characteristic and the second characteristic to determine the puff start and the puff stop.

Example Ex12. A method according to example Ex12 in which a puff start is determined when the first characteristic and the second characteristic satisfy one or more predetermined conditions.

Example Ex13. A method according to example Ex11 or Ex12 in which a puff end is determined when the first characteristic and the second characteristic satisfy one or more predetermined conditions.

Example Ex14. A method according to any of examples Ex10 to Ex13 in which the first characteristic is a first moving average value of the monitored parameter computed on a first time window having a first time window duration.

Example Ex15. A method according to any of examples Ex11 to Ex14 in which the second characteristic is a second moving average value of the monitored parameter computed on a second time window having a second time window duration, the second time window duration being different to the first time window duration.

Example Ex16. A method according to example Ex15 in which a puff start is determined when the first moving average value and the second moving average value meet a predetermined relationship with respect to each other.

Example Ex17. A method according to example Ex16 in which the first time window duration is shorter that the second time window duration and a puff start is determined when the first moving average increases with respect to the second moving average and reaches a puff start value in which the first moving average equals the second moving average plus a first predetermined puff start constant.

Example Ex18. A method according to example Ex17 in which a puff end is determined when the first moving average decreases with respect to the second moving average, after the detection of a puff start, and reaches a puff end value in which the first moving average is greater than the second moving average minus a first predetermined puff end constant, and the second moving average is lesser than the value of the second moving average at puff start plus a second predetermined puff end constant.

Example Ex19. A method according to any of examples Ex10 to Ex13 in which the first characteristic is a first moving median value of the monitored parameter computed on a first time window having a first time window duration.

Example Ex20. A method according to any of examples Ex11 to Ex14 and Ex19 in which the second characteristic is a second moving median value of the monitored parameter computed on a second time window having a second time window duration, the second time window duration being different to the first time window duration.

Example Ex21. A method according to example Ex20 in which a puff start is determined when the first moving median value and the second moving median value meet a predetermined relationship with respect to each other.

Example Ex22. A method according to example Ex21 in which the first time window duration is shorter that the second time window duration and a puff start is determined when the first moving median increases with respect to the second moving median and reaches a puff start value in which the first moving median equals the second moving median plus a first predetermined puff start constant.

Example Ex23. A method according to example Ex22 in which a puff end is determined when the first moving median decreases with respect to the second moving median, after the detection of a puff start, and reaches a puff end value in which the first moving median is greater than the second moving median minus a first predetermined puff end constant, and the second moving median is lesser than the value of the second moving median at puff start plus a second predetermined puff end constant.

Example Ex24. A method according to any preceding example in which the monitored parameter is analysed to detect at least one validation condition, or trigger, occurring after the puff start and before the puff end, detection of the at least one validation condition, or trigger, being necessary for a valid puff to be recorded.

Example Ex25. A method according to example Ex24 in which a validation condition, or trigger, is determined when the first characteristic and the second characteristic satisfy one or more predetermined conditions.

Example Ex26. A method according to any preceding example in which the or each puff volume is determined by integration of a curve representing the monitored parameter as a function of time between the puff or each puff start and the or each puff end.

Example Ex27. An aerosol-generating device for generating an aerosol from an aerosol-forming substrate, the aerosol-generating device comprising; a power supply for supplying power to generate the aerosol, and a controller configured to; monitor a parameter indicative of aerosol generation during operation of the aerosol-generating device, analyse the monitored parameter to identify a user puff, the user puff defined by a puff start and a puff end, analyse the monitored parameter during the user puff to calculate a puff volume, the puff volume being a volume of aerosol generated during the user puff, and control operation of the device based on calculated the puff volume.

Example Ex28. An aerosol-generating device according to example Ex27 configured to perform the method as defined in any of examples Ex1 to Ex25.

Example Ex29. An aerosol-generating device according to examples Ex27 or Ex28 in which the device comprises a heater and the monitored parameter is, or is representative of, power supplied to the heater during operation of the aerosol-generating device.

Example Ex30. An aerosol-generating device according to example Ex29 in which the heater is an induction heater and the monitored parameter is representative of energy absorbed by a susceptor.

Example Ex31. An aerosol-generating device according to example Ex29 in which the heater is a resistance heater and the monitored parameter is representative of energy supplied to the resistance heater.

Example Ex32. An aerosol-generating device according to any of examples Ex27 to Ex32 configured to receive an aerosol-generating article comprising the aerosol-forming substrate.

Example Ex23. A method of operating an aerosol-generating device for generating an aerosol from an aerosol-forming substrate, the aerosol-generating device comprising; a power supply for supplying power to generate the aerosol, and a controller; the method comprising, monitoring a parameter indicative of aerosol generation during operation of the aerosol-generating device, and analysing the monitored parameter to identify a user puff, the user puff defined by a puff start and a puff end, in which the step of analysing the monitored parameter comprises steps of calculating a first characteristic of the monitored parameter, calculating a second characteristic of the monitored parameter, and analysing both the first characteristic and the second characteristic to determine the puff start and the puff stop.

Example Ex34. A method according to example Ex33 comprising the steps of, analysing the monitored parameter to identify a plurality of user puffs performed during operation of the device, each of the plurality of user puffs having a puff start and a puff end determined by analysing the monitored parameter.

Example Ex35. A method according to example Ex33 or Ex34 in which the aerosol-generating device is configured to generate the aerosol during a usage session, the method comprising steps of, determining a start of the usage session, and analysing the monitored parameter to identify the user puff, or the plurality of user puffs, performed during operation of the device.

Example Ex36. A method according to any of examples Ex33 to Ex35 in which a puff start is determined when the first characteristic and the second characteristic satisfy one or more predetermined conditions.

Example Ex37. A method according to any of examples Ex33 to Ex36 in which a puff end is determined when the first characteristic and the second characteristic satisfy one or more predetermined conditions.

Example Ex38. A method according to any of examples Ex33 to Ex37 in which the first characteristic is a first moving average value of the monitored parameter computed on a first time window having a first time window duration.

Example Ex39. A method according to any of examples Ex33 to Ex38 in which the second characteristic is a second moving average value of the monitored parameter computed on a second time window having a second time window duration, the second time window duration being different to the first time window duration.

Example Ex40. A method according to example Ex39 in which a puff start is determined when the first moving average value and the second moving average value meet a predetermined relationship with respect to each other.

Example Ex41. A method according to example Ex40 in which the first time window duration is shorter that the second time window duration and a puff start is determined when the first moving average increases with respect to the second moving average and reaches a puff start value in which the first moving average equals the second moving average plus a first predetermined puff start constant.

Example Ex42. A method according to example Ex41 in which a puff end is determined when the first moving average decreases with respect to the second moving average, after the detection of a puff start, and reaches a puff end value in which the first moving average is greater than the second moving average minus a first predetermined puff end constant, and the second moving average is lesser than the value of the second moving average at puff start plus a second predetermined puff end constant.

Example Ex43. An aerosol-generating device for generating an aerosol from an aerosol-forming substrate, the aerosol-generating device comprising; a power supply for supplying power to generate the aerosol, and a controller configured to, monitor a parameter indicative of aerosol generation during operation of the aerosol-generating device, and analyse the monitored parameter to identify a user puff, the user puff defined by a puff start and a puff end, in which the controller is programmed to analyse the monitored parameter by calculating a first characteristic of the monitored parameter, calculating a second characteristic of the monitored parameter, and analysing both the first characteristic and the second characteristic to determine the puff start and the puff stop.

Example Ex44. An aerosol-generating device according to example Ex43 configured to perform the method as defined in any of examples Ex33 to Ex42.

Example Ex45. An aerosol-generating device according to example Ex43 or EX44 in which the device comprises a heater and the monitored parameter is, or is representative of, power supplied to the heater during operation of the aerosol-generating device.

Example Ex46. An aerosol-generating device according to example Ex45 in which the heater is an induction heater and the monitored parameter is representative of energy absorbed by a susceptor.

Example Ex47. An aerosol-generating device according to example Ex45 in which the heater is a resistance heater and the monitored parameter is representative of energy supplied to the resistance heater.

Example Ex48. An aerosol-generating device according to any of examples Ex43 to Ex47 configured to receive an aerosol-generating article comprising the aerosol-forming substrate.

Examples will now be further described with reference to the figures in which.

Figure 2:
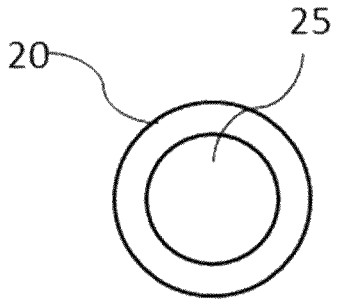
FIG. 2 illustrates a schematic upper end view of the aerosol-generating device of FIG. 1.
Figure 1:
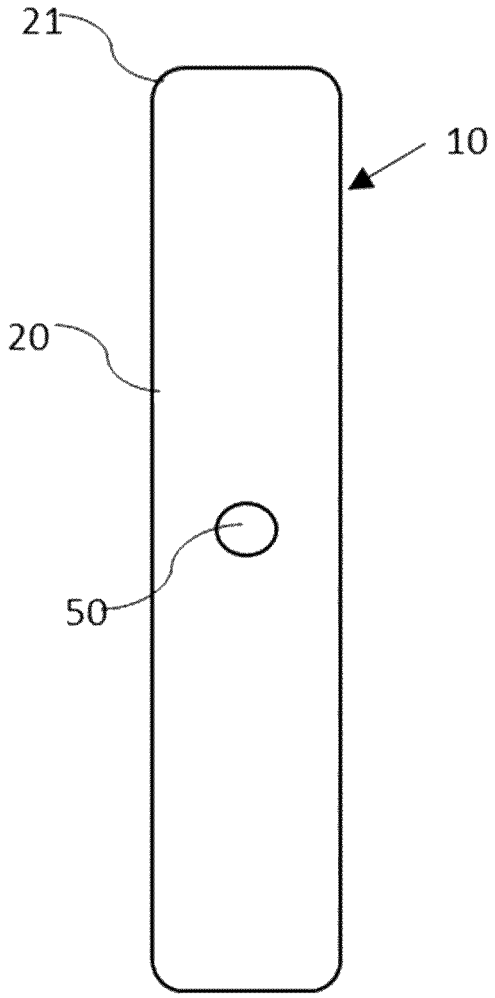
FIG. 1 illustrates a schematic side view of an aerosol-generating device.
Figure 3:
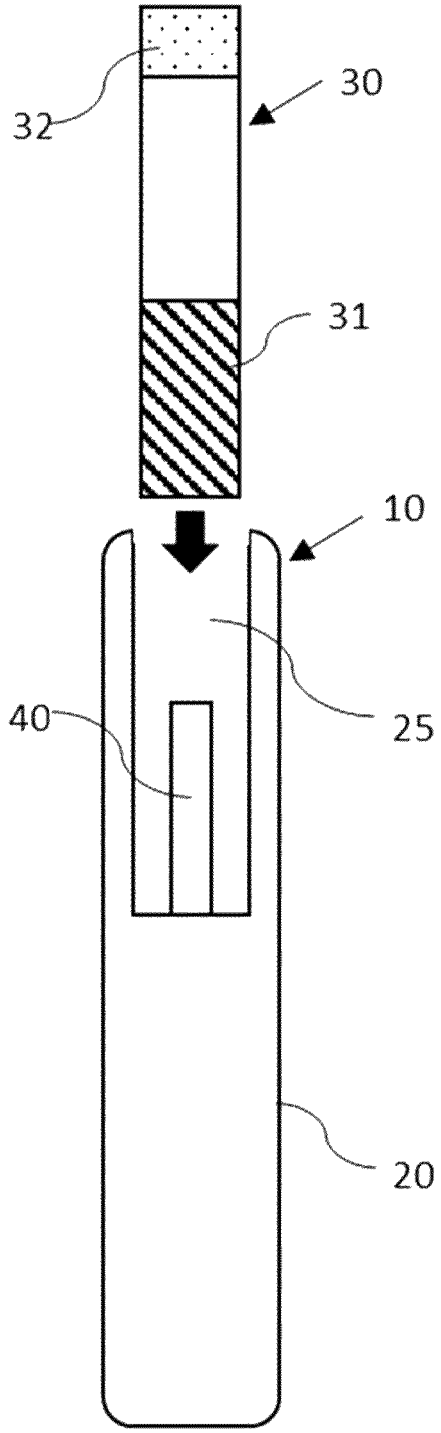
FIG. 3 illustrates a schematic cross-sectional side view of the aerosol-generating device of FIG. 1 and an aerosol-generating article for use with the device.

An exemplary aerosol-generating device 10 is a hand-held aerosol generating device, and has an elongate shape defined by a housing 20 that is substantially circularly cylindrical in form. The aerosol-generating device 10 comprises an open cavity 25 located at a proximal end 21 of the housing 20 for receiving an aerosol-generating article 30 comprising an aerosol-forming substrate 31. The aerosol-generating device 10 further comprises a battery (not shown) located within the housing 20 of the device, and an electrically operated heater element 40 arranged to heat at least an aerosol-forming substrate portion 31 of an aerosol-generating article 30 when the aerosol-generating article 30 is received in the cavity 25.

The aerosol-generating device is configured to receive a consumable aerosol-generating article 30. The aerosol-generating article 30 is in the form of a cylindrical rod and comprises an aerosol-forming substrate 31. The aerosol-forming substrate is a solid aerosol-forming substrate comprising tobacco. The aerosol-generating article 30 further comprises a mouthpiece such as a filter 32 arranged in coaxial alignment with the aerosol-forming substrate within the cylindrical rod. The aerosol-generating article 30 has a diameter substantially equal to the diameter of the cavity 25 of the device 10 and a length longer than a depth of the cavity 25, such that when the article 30 is received in the cavity 25 of the device 10, the mouthpiece 32 extends out of the cavity 25 and may be drawn on by a user, similarly to a conventional cigarette.

In use, a user inserts the article 30 into the cavity 25 of the aerosol-generating device 10 and turns on the device 10 by pressing a user button 50 to activate the heater 40 to start a usage session. The heater 40 heats the aerosol-forming substrate of the article 30 such that volatile compounds of the aerosol-forming substrate 31 are released and atomised to form an aerosol. The user draws on the mouthpiece of the article 30 and inhales the aerosol generated from the heated aerosol-forming substrate. After activation, the temperature of the heater element 40 increases from an ambient temperature to a predetermined temperature for heating the aerosol-forming substrate. Control electronics of the device 10 supply power to the heater from the battery to maintain the temperature of the heater at an approximately constant level as a user puffs on the aerosol-generating article 30. The heater continues to heat the aerosol-generating article until an end of the usage session, when the heater is deactivated and cools. In some specific examples the heater 40 may be a resistance heater element. In some specific examples the heater 40 may be a susceptor arranged within a fluctuating magnetic field such that it is heated by induction.

At the end of the usage session, the article 30 is removed from the device 10 for disposal, and the device 10 may be coupled to an external power source for charging of the battery of the device 10.

The aerosol-generating article for use with the device has a finite quantity of aerosol-forming substrate and, thus, a usage session needs to have a finite duration to prevent a user trying to produce aerosol when the aerosol-forming substrate has been depleted. A usage session is configured to have a maximum duration determined by a period of time from the start of the usage session. A usage session is also configured to have a duration of less than the maximum duration if a user interaction parameter recorded during the usage session reaches a threshold before the maximum duration as determined by the timer. In a specific embodiment the user interaction parameter is representative of cumulative volume of aerosol generated by the user during puffs taken by the user during the usage session. Thus, the aerosol-generating device is configured such that each usage session has a maximum duration of 6 minutes from initiation of the usage session, or a total of 660 ml of aerosol generated by the user (equivalent to 12 puffs of 55 ml) if 660 ml of aerosol is generated within 6 minutes from initiation of the usage session. Thus, a user making a high number of short puffs, or gentle puffs, may receive a similar maximum amount of aerosol as a user taking fewer long puffs or energetic puffs.

Figure 4:
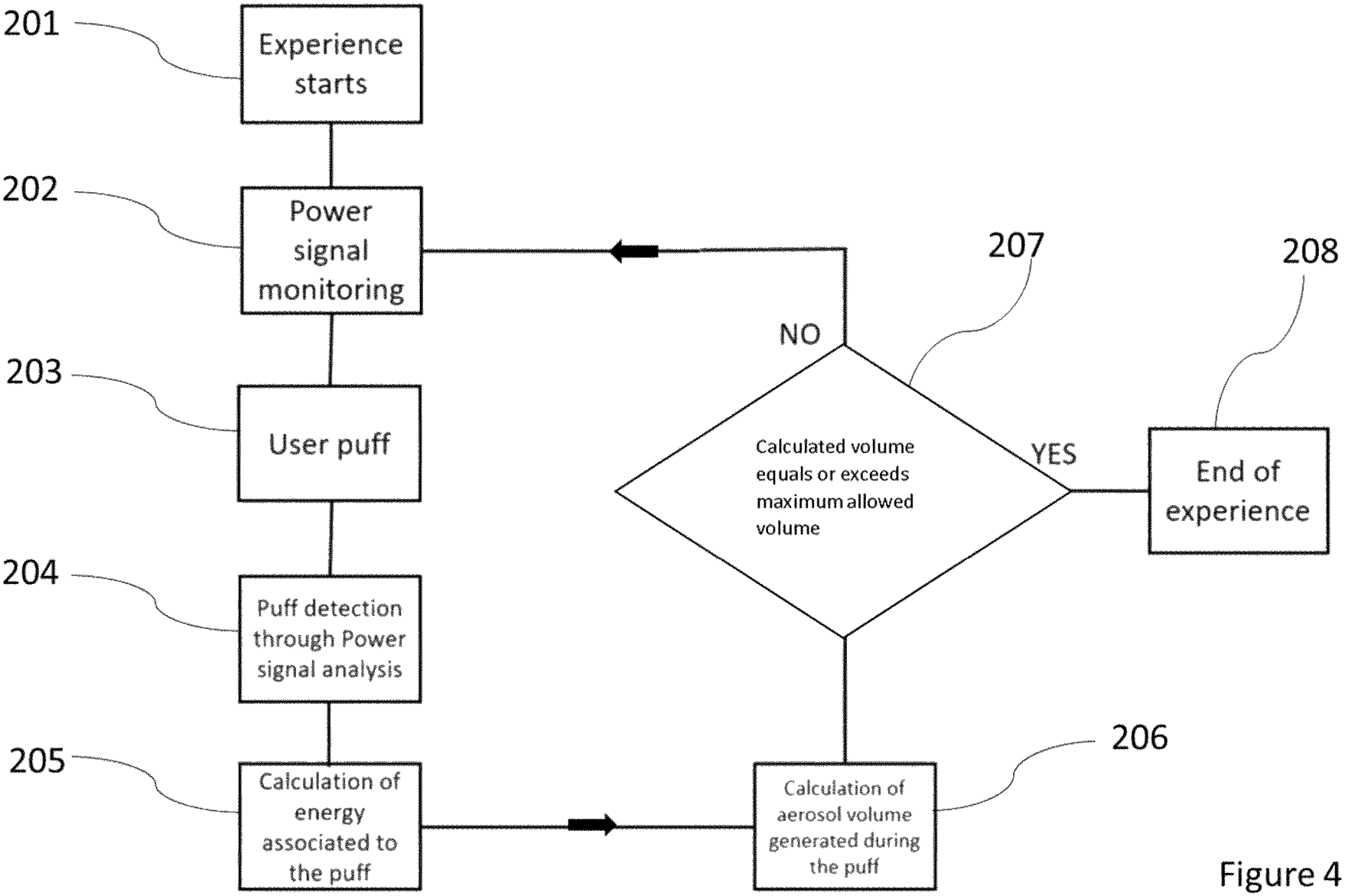
FIG. 4 is a flow diagram illustrating a method of operating an aerosol-generating device by calculation of puff volume.

An overview of the method is schematically illustrated in FIG. 4. A user inserts an aerosol-generating article into the aerosol-generating device and initiates a usage session by actuating the user button 50. This indicates the start of the user experience 201. Power is supplied from a battery in the aerosol-generating device to the heater element 40 until the heater element reaches a predetermined operating temperature. This temperature may be, for example, about 330 degrees Centigrade.

The power signal of the power supplied to the heater is monitored 202. The user then takes a puff 203. When the user puffs, the heater is cooled because of the airflow. Thus, the power that needs to be supplied to the heater to maintain the operating temperature increases. The power supplied increases and the correct temperature is maintained.

The presence of a user puff is detected by analysing the power signal 204. A puff start point and a puff end point are determined by means of this analysis.

The energy of the detected puff is then calculated 205 and the volume of aerosol generated during the puff is also calculated 206 and added to a cumulative total of volume generated during the usage session.

If the cumulative total volume equals or exceeds the predetermined maximum permissible aerosol volume for the usage session (for example 660 ml) the usage session is ended 208. If the cumulative total volume does not equal or exceeds the predetermined maximum permissible aerosol volume for the usage session then the session remains active and the user may take another puff. The usage session remains active until the user has generated the maximum permissible aerosol volume or until a maximum time threshold is reached.

The concept of controlling duration of a usage session of an aerosol-generating device based on number of puffs taken is known. Puffs can be identified by either monitoring power or by monitoring airflow. To quantify the volume of aerosol delivered, however, an accurate detection and analysis of each puff is required. Many factors affect a power signal under operating conditions and power as a function of time in an aerosol-generating device is noisy and complicated. In real applications a power signal carries background noise and it is not simple to associate with certainty a specific behaviour to the occurrence of a puff. Simple threshold analysis of the power signal to determine puffs does not provide the precision required to undertake a quantification of the volume of aerosol generated.

In order to provide a more accurate determination of puff start points and puff end points, two moving averages of power as a function of time are compared. Relationships between the two moving averages are analysed in real time and specific points, including a puff start point and a puff end point are determined. Specific points determined by the analysis of the two moving averages may be termed trigger points.

Figure 5:
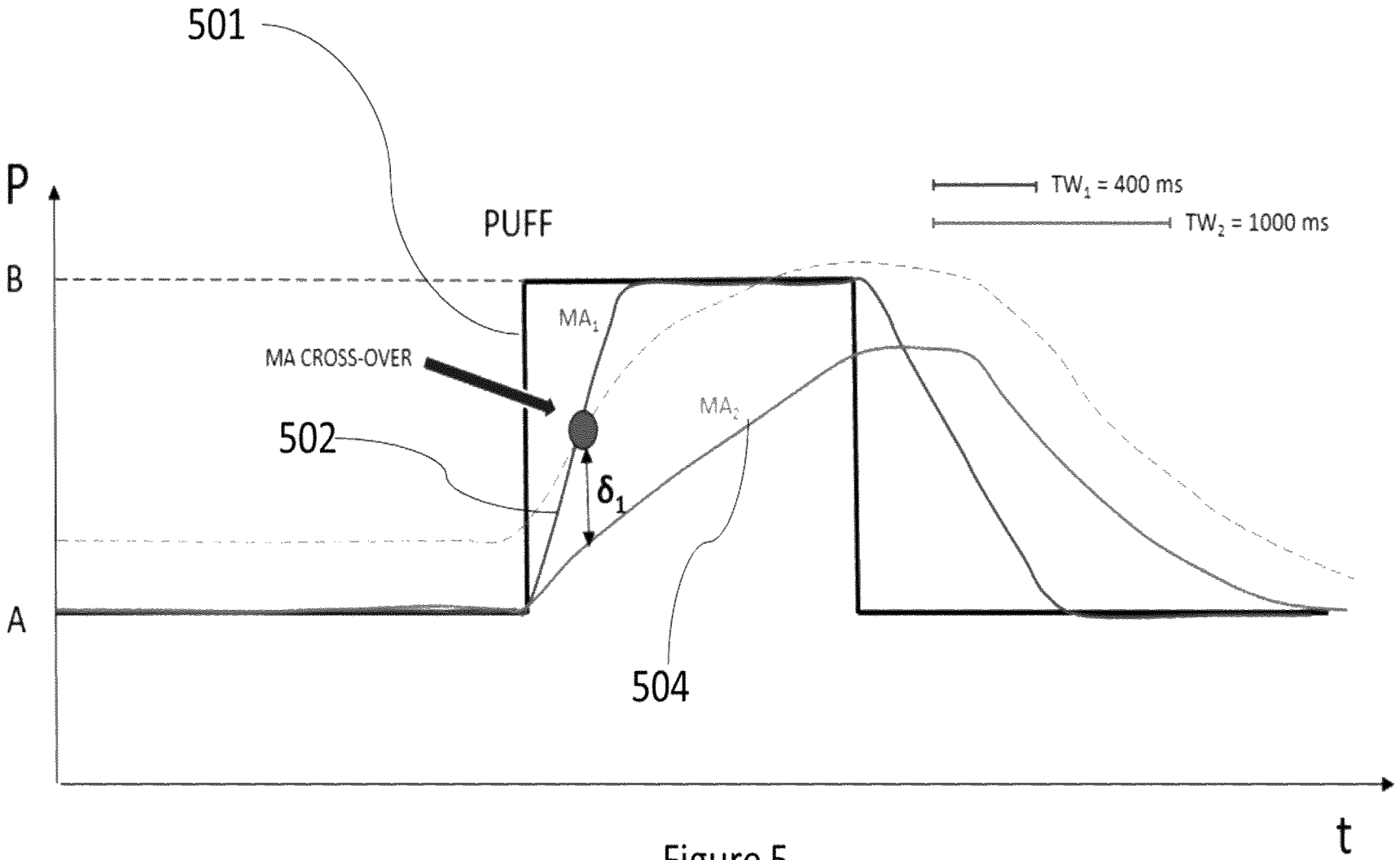
FIG. 5 is a graph illustrating power as a function of time during a user puff, and two moving averages of the power curve, in particular illustrating the detection point of a puff.

FIG. 5 shows a graph illustrating power supplied to a heater as a function of time. The function P (power) of time has the trend depicted in the graph as a square curve 501.

A first moving average 502 (MA1) is an average value of the power signal over a first time window TW1. The first time window TW1 is, in this specific example, approximately 400 ms.

A second moving average 504 (MA2) is an average value of the power signal over a second time window TW2. The second time window TW2 is, in this specific example, approximately 1000 ms.

In a first portion of the graph 503, the heater is at a constant temperature and the user is not taking a puff. Thus, power supplied to the heater to maintain the operating temperature is constant and equal to a value shown as A on the graph. In the first portion of the graph 503 the value of the first moving average 502 coincides with the value of the power 501, as the power is constant and equal to a value A, therefore the average value over time window TW1 is also constant over time. In the first portion of the graph 503 the value of the second moving average 504 coincides with the value of the power 501, as the power is constant and equal to a value A, therefore the average value over time window TW2 is also constant over time.

When a user takes a puff, the heater is cooled by the resulting airflow. Thus, the power supplied to the heater needs to increase to maintain the heater at its operating temperature. As depicted in FIG. 5, the power increases from the value denoted as A to a higher value denoted as B. As the user completes a puff, the power needed to be supplied to the heater to maintain an operating temperature decreases, and the power supplied decreases back to the maintenance level denoted by A.

After the increase in power, the first moving average progressively increases, but not as steeply as the power signal since it also includes a portion of signal which is still at value A. The first moving average continues to increase until there is coincidence with the power value. Then it decreases in similar fashion after the power decreases again.

After the increase in power, the second moving average progressively increases. As the second moving average is based on a longer time window TW2 than the first moving average, the second moving average starts to rise in the proximity of the puff region but more gradually than the first moving average.

Having obtained a first moving average and a second moving average, conditions may be set in order to detect a puff. Firstly, a significant event is defined, identified as the moving average cross-over: MA1=MA2+δ1. When the first moving average equals the second moving average plus a first constant (δ1), the event is called moving average cross-over. The constant δ1 is a value experimentally determined. According to a preferred specific example, the first constant (δ1)=0.22 W. A puff start is determined to have occurred when the relationship between the first moving average and the second moving average meets, or exceeds, the conditions defined for the moving average crossover. That is, a puff start is determined to have occurred when the relationship between the first moving average and the second moving average changes from MA1<MA2+δ1 to MA1=MA2+δ1 or MA1>MA2+δ1. The moving average cross-over corresponds to a perturbation of the power signal that is big enough to be quantified as a puff. This methodology has an advantage when the power signal carries a lot of background noise, and the behaviour correspondent to the occurrence of a puff otherwise may not be easy to detect.

Conditions may also be defined which, when verified, are indicative of the occurrence of a puff. After the moving average crossover has been detected, then four conditions (or triggers) may be verified to spot a puff by monitoring the power signal. These validation conditions, or triggers, can be identified as Trigger 1, Trigger 2, Trigger 3, and Trigger 4, and are defined as follows.

TRIGGER 1: The condition for trigger 1 is MA1>MA2+δ1. Trigger 1 is tied to the puff start. When trigger 1 is detected, immediately after the moving average cross-over, then the system knows that such detection corresponds to the beginning of a puff.

Figure 6:
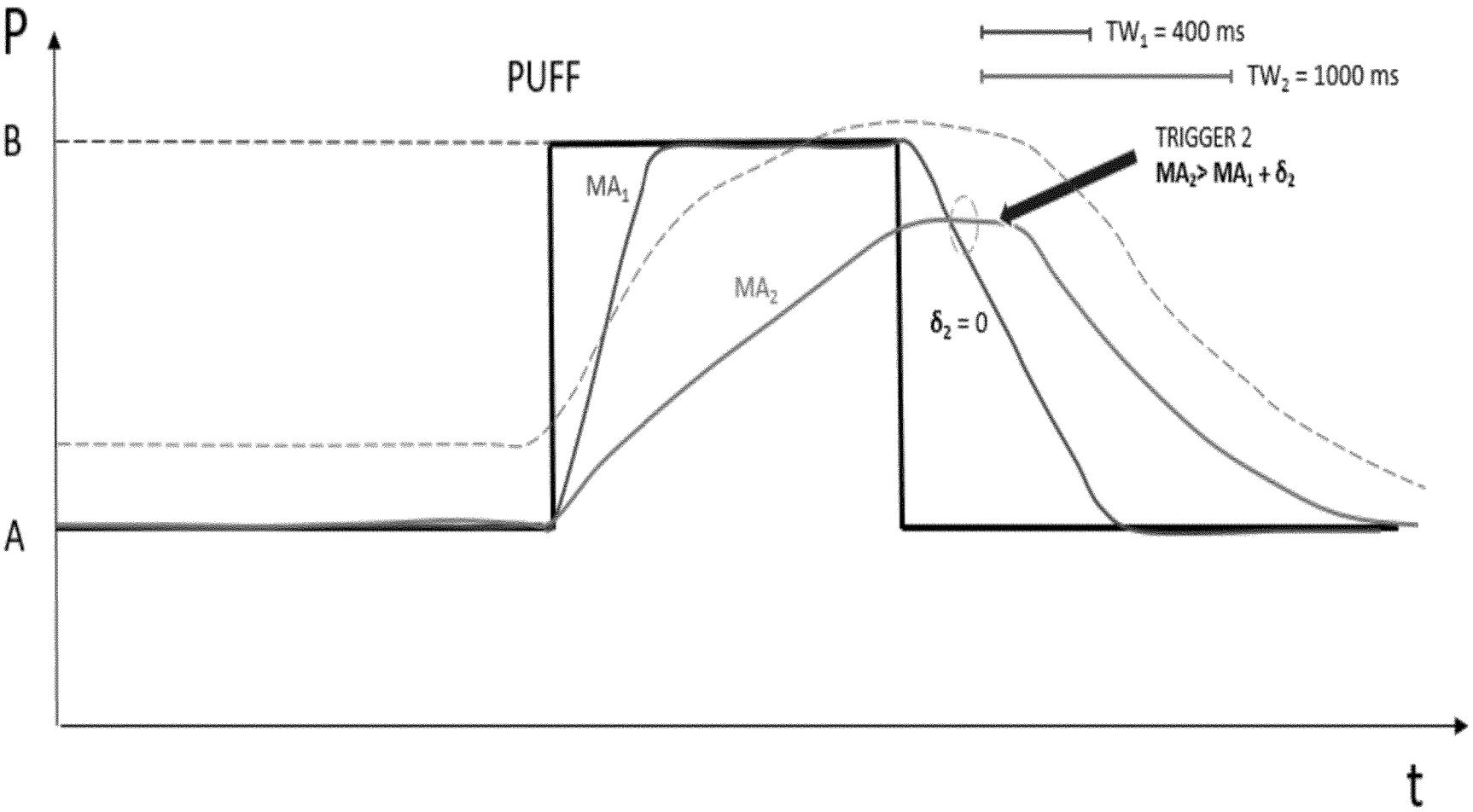
FIG. 6 is a graph illustrating power as a function of time during a user puff, and two moving averages of the power curve, in particular illustrating a second trigger point.

TRIGGER 2: The condition for trigger 2 is $MA_2>MA_1+\delta_2$. Trigger 2 identifies the peak of the puff. In this case, $\delta_2$ is a second constant. According to the preferred specific example, the second constant (δ2)=0 W. The position of Trigger 2 is illustrated in FIG. 6.

TRIGGER 3: The condition for trigger 3 is MA2>MA1+δ3. This trigger identifies the fading of the puff, δ3 is a third constant.

Figure 7:
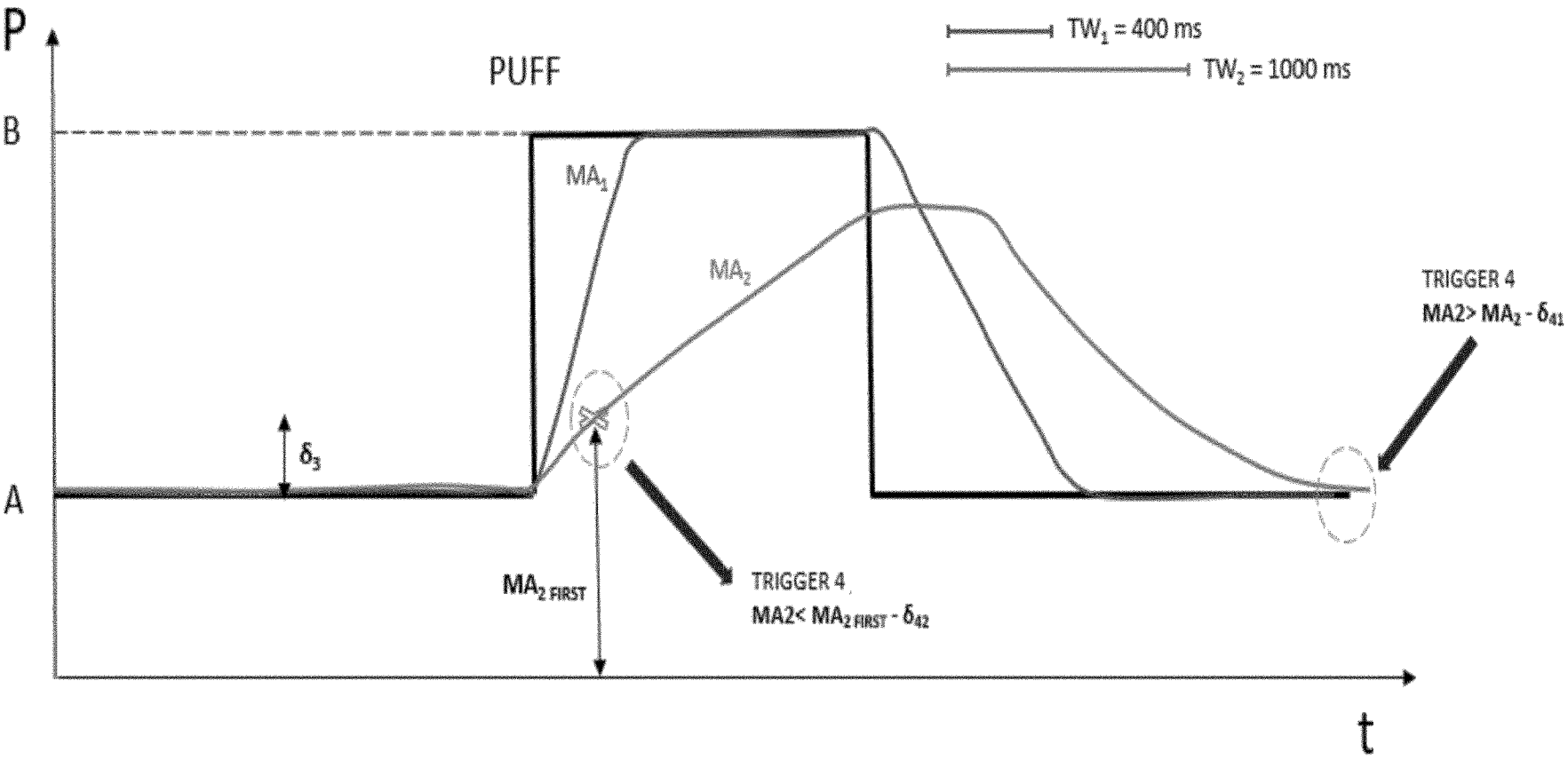
FIG. 7 is a graph illustrating power as a function of time during a user puff, and two moving averages of the power curve, in particular illustrating the detection of the end point of a puff.

TRIGGER 4: The condition for trigger 4 is MA1>MA2−δ41 AND MA2<MA2 1ST+δ42. This trigger detects the end of the puff, δ41 is a fourth constant and δ42 is a fifth constant. δ41 and δ42 are experimentally calculated. According to the preferred specific example the fourth constant δ41 is 0.06 W and the fifth constant δ42 is 0.31 W. The conditions for trigger 4 are illustrated in FIG. 7.

Figure 8:
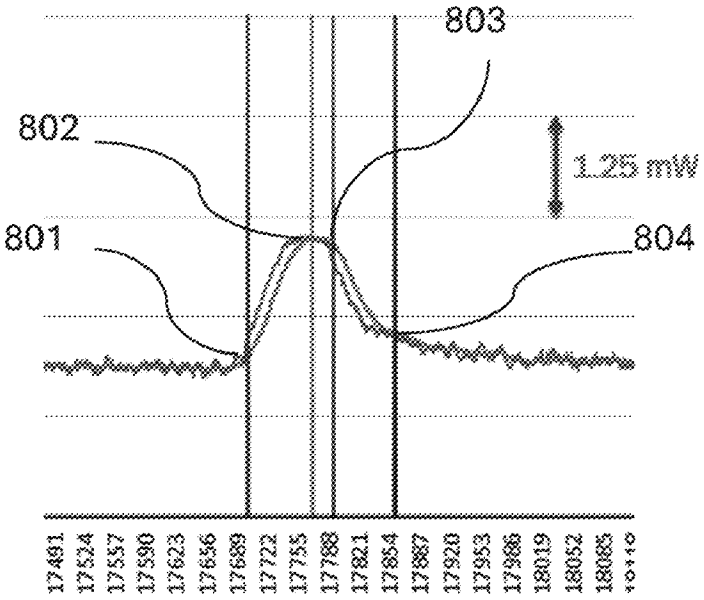
FIG. 8 is a graph illustrating the detection of a puff, including identification of various trigger points used to verify the puff.

FIG. 8 illustrates detection of a puff in a further specific embodiment. For this specific embodiment, the first moving average (MA1) was based on a time window of 128 ms and the second moving average (MA2) was based on a time window of 512 ms.

A puff is detected when the moving average cross over occurs 801. This is the point when MA1=MA2+δ1. δ1 is a constant that is experimentally determined and has a value of 0.22 W.

The first trigger occurs when MA1>MA2+δ1, i.e. immediately after the puff start.

The second trigger 802 occurs when MA2>MA1+δ2. δ2 is a constant that is experimentally determined and has a value of 0 W. Thus, the second trigger occurs when MA2>MA1.

The third trigger 803 occurs when MA2>MA1+δ3. δ3 is a constant that is experimentally determined and has a value of 0.18 W.

The fourth trigger 804 occurs when MA1>MA2−δ41 AND MA2<MA2 1ST+δ42. δ41 is a constant that is experimentally determined and has a value of 0.06 W. δ42 is a constant that is experimentally determined and has a value of 0.31 W. The puff is deemed to end at the fourth trigger.

In order to improve the accuracy of the puff detection, a set of time thresholds are established between different triggers. Such thresholds facilitate valid detection of puffs in very different volumes and flows. Time thresholds, or timeouts, are durations that initiated after a trigger is activated. If the following trigger is not activated after a predetermined period of time, the detection process is reset. This allows to discard "badly detected" triggers.

A first timeout may be initiated after the first trigger. If the second trigger is not detected within a predetermined period of time the puff detection is rejected and the detection system is reset. In a specific example the first timeout may have a duration of 2.5 seconds. Thus, if the second trigger is not detected within 2.5 seconds of the first trigger, the detection of the puff is rejected.

A second timeout may be initiated after the third trigger. If the fourth trigger is not detected within a predetermined period of time the puff detection is rejected and the detection system is reset. In a specific example the second timeout may have a duration of 3.5 seconds. Thus, if the fourth trigger is not detected within 3.5 seconds of the third trigger, the detection of the puff is rejected.

Figure 9:
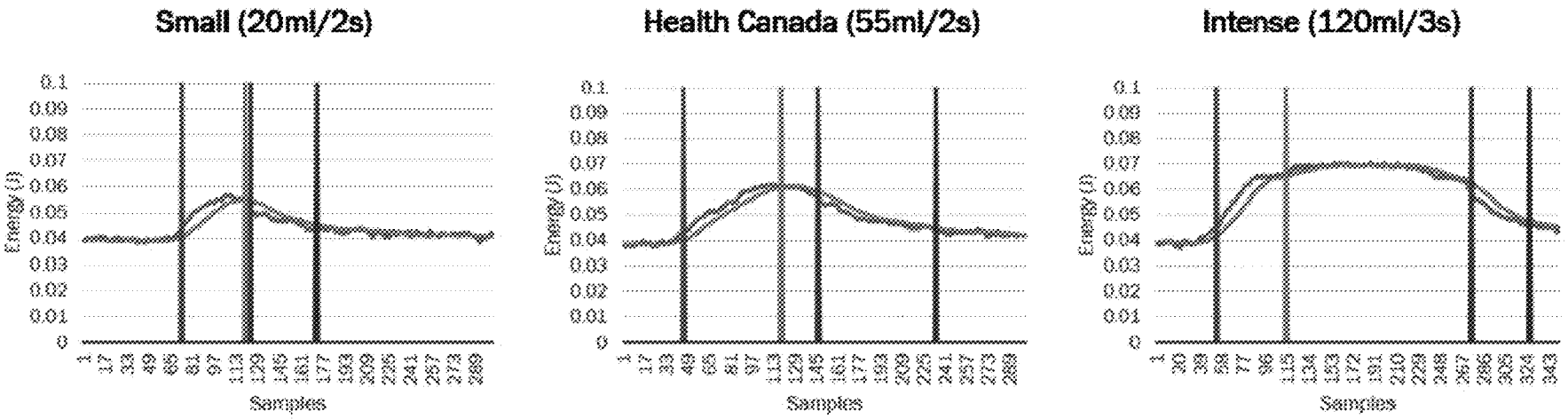
FIG. 9 illustrates the verification of the method using three different puffing modes.

The method according to the invention was used to detect puffs in three different modes. As shown in FIG. 9, the modes were puffs of 20 ml volume and 2 seconds duration, puffs of 55 ml volume and 2 seconds duration, and puffs of 120 ml volume and 3 seconds duration. 97% of the puffs were detected among these three very different puffing modes using the same thresholds and timeouts.

After the end point of the puff has been identified (fourth trigger), the volume of the puff is calculated from the integral of power in time from the puff start to the puff end. The integral of the power over time equals the energy. The energy in turn corresponds to the heat injected into the consumable, and the heat is what the user takes away with a volume of cooling airflow.

Figure 10:
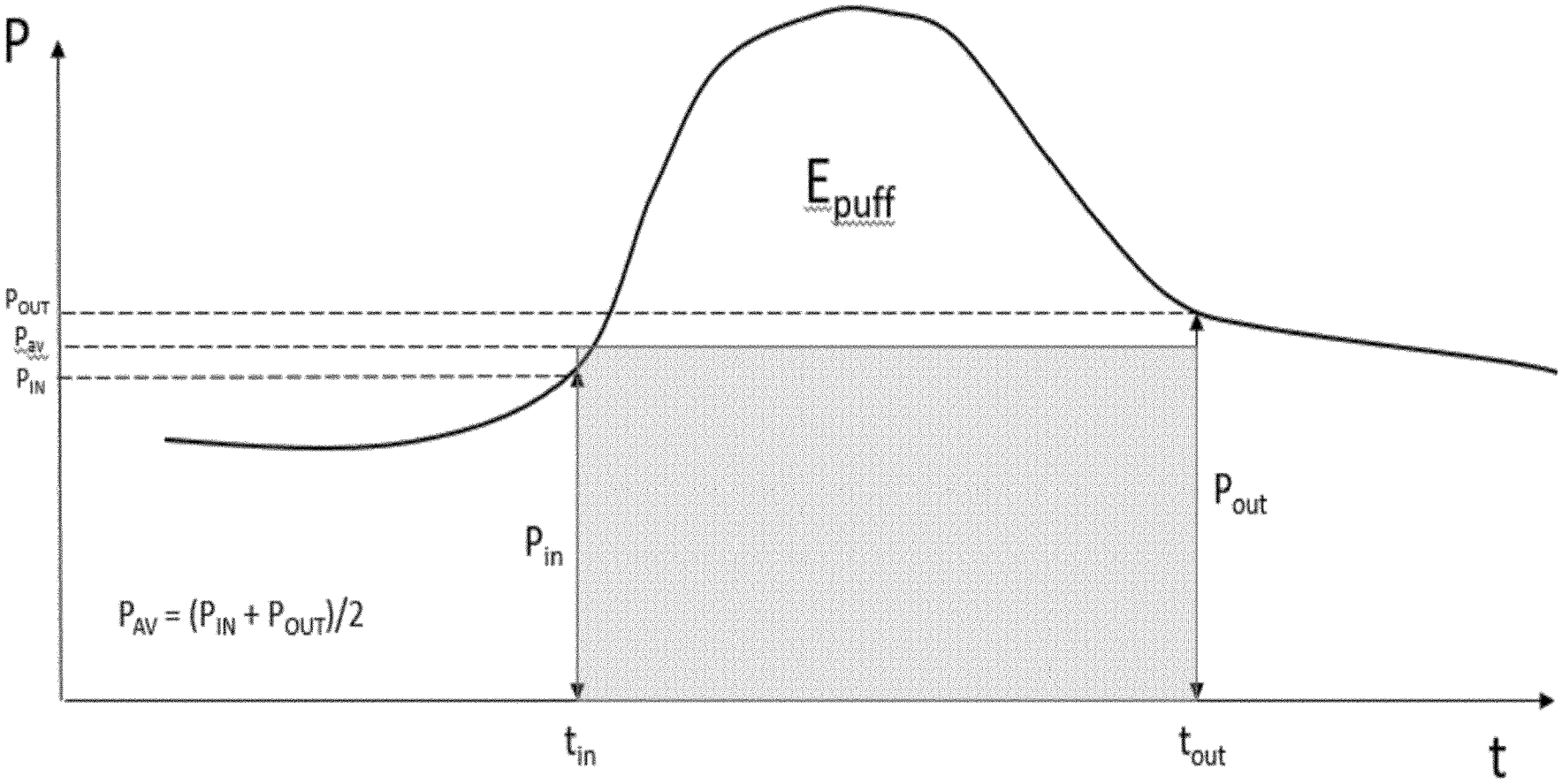
FIG. 10 is a graph illustrating the calculation of energy by integrating the power signal during the detected puff.

As illustrated in FIG. 10, it will be appreciated that the energy strictly associated to a puff will be calculated as the integral calculus of the power signal during the puff, minus the energy that would be spent anyway even without a puff, as indicated in the formula:

$$E_{puff} = \int_{t_{in}}^{t_{out}} P dt - \frac{(P_{in} + P_{out})}{2}(t_{out} - t_{in})$$

The energy is correlated to the volume through a relationship that has been determined empirically. Similarly, it is also possible to correlate the power to the air flow, which equals the volume per time unit.

The usage session, which may be termed a user experience, has a maximum permissible volume of aerosol to be delivered. Every puff contributes to the maximum permissible volume. Once the threshold has been reached, the experience ends. Therefore the experience is not tied to a predetermined number of puffs, but to the way the user actually puffs on the device.

An alternative method of determining overall volume of aerosol supplied during a usage session would be to use a flow sensor. But it will be appreciated that such solution would be cumbersome in terms of device complexity. Indeed, a flow sensor may clog with slurry, may clog with debris (if putting the device into a pocket full of dust). In terms of design, use of a flow sensor is particularly difficult because the flow sensor requires a non-negligible space. According to the present solution, there is no need of any additional hardware. The solution provided herein provides a layer of software on top of the existing heating algorithm, which is already capable of calculating the current and the voltage that is the power.

The invention claimed is:

1. An aerosol-generating device for generating an aerosol from an aerosol-forming substrate, the aerosol-generating device comprising;

a power supply configured to supply power to generate the aerosol; and a controller configured to monitor a parameter indicative of aerosol generation during operation of the aerosol-generating device, and to analyse a first characteristic of the monitored parameter and a second characteristic of the monitored parameter to identify a user puff, the user puff defined by a puff start and a puff end, wherein the parameter indicative of aerosol generation is a parameter representative of power supplied by the power supply, wherein the first characteristic is a first moving average value of the monitored parameter computed on a first time window having a first time window duration, wherein the second characteristic is a second moving average value of the monitored parameter computed on a second time window having a second time window duration, the second time window duration being different from the first time window duration, and wherein the puff start is determined when the first moving average value and the second moving average value meet a predetermined relationship with respect to each other.

2. The aerosol-generating device according to claim 1, the aerosol-generating device being configured to perform a method comprising:

monitoring a parameter indicative of aerosol generation during operation of the aerosol-generating device; and analysing the monitored parameter to identify a user puff, the user puff defined by a puff start and a puff end, wherein the step of analysing the monitored parameter comprises steps of calculating a first characteristic of the monitored parameter, calculating a second characteristic of the monitored parameter, and analysing both the first characteristic and the second characteristic to determine the puff start and the puff end.

3. The aerosol-generating device according to claim 1, further comprising a heater, and wherein the monitored parameter is, or is representative of, power supplied to the heater during operation of the aerosol-generating device.

4. The aerosol-generating device according to claim 1, the aerosol-generating device being configured to receive an aerosol-generating article comprising the aerosol-forming substrate.

5. The aerosol-generating device according to claim 3, wherein the heater is an induction heater and the monitored parameter is representative of energy absorbed by a susceptor.

6. The aerosol-generating device according to claim 3, wherein the heater is a resistance heater and the monitored parameter is representative of energy supplied to the resistance heater.

7. The aerosol-generating device according to claim 1, wherein the aerosol-generating device is configured to analyse the monitored parameter to identify a plurality of user puffs performed during operation of the device, each of the plurality of user puffs having a puff start and a puff end determined by analysing the monitored parameter.

8. The aerosol-generating device according to claim 1, wherein the aerosol-generating device is configured to:

generate the aerosol during a usage session, determine a start of the usage session, and analyse the monitored parameter to identify the user puff performed during operation of the device.

9. The aerosol-generating device according to claim 1, wherein the puff start is determined when the first characteristic and the second characteristic satisfy one or more predetermined conditions.

10. The aerosol-generating device according to claim 1, wherein the puff end is determined when the first characteristic and the second characteristic satisfy one or more predetermined conditions.

11. The aerosol-generating device according to claim 1, wherein the first time window duration is shorter than the second time window duration and the puff start is determined when the first moving average increases with respect to the second moving average and reaches a puff start value in which the first moving average equals the second moving average plus a first predetermined puff start constant.

12. The aerosol-generating device according to claim 11, wherein the puff end is determined when the first moving average decreases with respect to the second moving average, after the detection of the puff start, and reaches the puff end value in which the first moving average is greater than the second moving average minus a first predetermined puff end constant, and the second moving average is lesser than the value of the second moving average at puff start plus a second predetermined puff end constant.

13. The aerosol-generating device according to claim 1, wherein the aerosol-generating device is configured to:

analyse the monitored parameter during the user puff to calculate a puff volume, the puff volume being a volume of aerosol generated during the user puff, and use the puff volume as a parameter for controlling operation of the device.

14. The aerosol-generating device according to claim 13, wherein the aerosol-generating device is configured to:

generate the aerosol during a usage session, determine a start of the usage session, monitor the parameter indicative of aerosol generation during the usage session, and use the puff volume as a parameter for determining the end of the usage session.

15. The aerosol-generating device according to claim 1, wherein the aerosol-generating device is configured to:

analyse the monitored parameter to identify a plurality of user puffs performed during operation of the device, each of the plurality of user puffs having a puff start and a puff end determined by analysing the monitored parameter, analyse the monitored parameter during each of the plurality of identified user puffs to calculate a puff volume for each of the plurality of user puffs, determine a cumulative puff volume of aerosol generated during each of the plurality of identified user puffs, and use the cumulative puff volume as a parameter for controlling operation of the device.

16. The aerosol-generating device according to claim 15, wherein the aerosol-generating device is configured to:

generate the aerosol during a usage session, determine a start of the usage session, monitor the parameter indicative of aerosol generation during the usage session, and use the cumulative puff volume as a parameter for determining the end of the usage session.

17. The aerosol-generating device according to claim 14, wherein the controller ends the usage session if a time elapsed from the start of the usage session reaches a predetermined threshold.

18. The aerosol-generating device according to claim 16, wherein the controller ends the usage session if a time elapsed from the start of the usage session reaches a predetermined threshold.

19. The aerosol-generating device according to claim 14, wherein the controller ends the usage session if the puff volume generated from the start of the usage session reaches a predetermined threshold.

* * * * *